US007021756B2

(12) United States Patent
Nakashima et al.

(10) Patent No.: US 7,021,756 B2
(45) Date of Patent: Apr. 4, 2006

(54) INKJET PRINTER

(75) Inventors: Atsuhisa Nakashima, Nagoya (JP); Tsugio Okamoto, Kani (JP); Osamu Takagi, Nagoya (JP); Susumu Kuzuya, Gifu (JP)

(73) Assignee: Brother Kogyo Kaushsiki Kaisha, Nagoya (JP)

( * ) Notice: Subject to any disclaimer, the term of this patent is extended or adjusted under 35 U.S.C. 154(b) by 28 days.

(21) Appl. No.: 10/791,794

(22) Filed: Mar. 4, 2004

(65) Prior Publication Data

US 2004/0228669 A1 Nov. 18, 2004

(30) Foreign Application Priority Data

Mar. 4, 2003 (JP) ..... 2003-057353

(51) Int. Cl.
*B41J 2/165* (2006.01)

(52) U.S. Cl. ..... 347/104; 347/35; 347/36; 271/198; 271/275

(58) Field of Classification Search ..... 347/22, 347/35, 36, 104; 271/198, 275
See application file for complete search history.

(56) References Cited

U.S. PATENT DOCUMENTS

| | | | | |
|---|---|---|---|---|
| 4,207,578 | A * | 6/1980 | Marinoff | 347/35 |
| 5,040,000 | A * | 8/1991 | Yokoi | 347/30 |
| 5,291,227 | A * | 3/1994 | Suzuki | 347/104 |
| 6,239,817 | B1 * | 5/2001 | Meyer | 347/36 |
| 6,575,554 | B1 | 6/2003 | Yoshinaga | 347/22 |
| 6,672,705 | B1 * | 1/2004 | Kitahara et al. | 347/42 |
| 6,733,109 | B1 * | 5/2004 | Lorenz et al. | 347/36 |
| 2002/0041303 | A1 | 4/2002 | Yoshinaga | 347/22 |

FOREIGN PATENT DOCUMENTS

| | | |
|---|---|---|
| JP | A 5-294517 | 11/1993 |
| JP | A 7-334630 | 12/1995 |
| JP | A 8-268600 | 10/1996 |
| JP | A 9-109377 | 4/1997 |
| JP | A 11-322089 | 11/1999 |
| JP | A 2000-272110 | 10/2000 |
| JP | A 2001-105628 | 4/2001 |
| JP | A 2001-302012 | 10/2001 |
| JP | A 2002-36605 | 2/2002 |
| JP | A 2002-103721 | 4/2002 |
| JP | A 2002-187261 | 7/2002 |
| JP | A 2002-211060 | 7/2002 |

* cited by examiner

*Primary Examiner*—Andrew H. Hirshfeld
*Assistant Examiner*—Jill E. Culler
(74) *Attorney, Agent, or Firm*—Oliff & Berridge, PLC

(57) ABSTRACT

An inkjet printer includes a plurality of rollers, an endless transportation belt, a belt rotating mechanism, a recording unit, a printing medium supply mechanism, and a control unit. The transportation belt is laid on the rollers and defines a first recess portion, which extends in a direction perpendicular to a printing medium transporting direction, in an outer circumferential surface thereof. The belt rotating mechanism applies a rotating force to the transportation belt. The recording unit is disposed to face the transportation belt and forms an image. The printing medium supply mechanism supplies a printing medium onto the transportation belt. The control unit controls at least one of the belt rotating mechanism and the printing medium supply mechanism so that when the printing medium is on the transportation belt, one of front and rear end portions of the printing medium is located in the first recess portion.

20 Claims, 7 Drawing Sheets

INKJET PRINTER

BACKGROUND OF THE INVENTION

1. Field of the Invention

The present invention relates to an inkjet printer capable of ejecting ink droplets onto a printing medium and thereby printing a desired image, and particularly relates to an inkjet printer capable of printing an image without leaving any margin on a printing medium.

2. Description of the Related Art

In an inkjet printer, ink droplets are ejected from nozzles, respectively, so as to print a desired image on a printing medium such as recording paper. Some inkjet printers perform so-called zero-margin printing in which an image is recorded on recording paper without any margin.

An inkjet recording apparatus disclosed in JP-A-2002-211060 (pages 4–6; and FIGS. 1–3) has a paper supply portion capable of stacking a plurality of sheets of paper. Paper is carried and transported from the paper supply portion on a transportation portion provided on transportation belts. Then, ink is ejected onto the paper from an inkjet head. Thus, printing is performed. Here, the transportation portion is formed as protrusion portions (convex portions) on the transportation belts. When the paper is put on the transportation portion, a paper front end detection sensor detects the front end portion of the paper, and a transportation belt position detection sensor detects the position of the transportation portion on the transportation belts. A paper feeding/transporting roller controlled by a control portion rotates to feed the paper from the paper supply portion. Thus, the paper is put on the transportation portion so that both ends of the paper in the paper transporting direction overreach the transportation portion. Then, a recording head is controlled by the control portion to eject ink over an area larger than the size of the paper. Thus, zero-margin printing is performed without leaving any margin on the paper.

The transportation portion is formed thus as protrusion portions on a plurality of transportation belts, and the upper surface of the transportation portion is covered with paper without being exposed. Accordingly, when paper whose length in the paper transporting direction is longer than that of the transportation portion is used, zero-margin printing can be performed with no fear that ink overreaching the front end portion and the rear end portion of the paper adheres to the transportation portion.

In addition, the inkjet recording apparatus disclosed in JP-A-2002-211060 uses a plurality of transportation belts disposed in parallel with one another and at a distance from one another. Accordingly, when zero-margin printings are performed on a plurality of kinds of papers different in length in a direction perpendicular to the paper transporting direction, each of the side portions of the paper in the paper transporting direction is positioned in a space between adjacent ones of the plurality of transportation belts. Thus, zero-margin printing can be performed with no fear that ink overreaching the side portions of the paper adheres to the transportation portion.

SUMMARY OF THE INVENTION

However, the inkjet recording apparatus disclosed in JP-A-2002-211060 has the following problems. First, when zero-margin printing is performed on paper put on the transportation portion whose length in the paper transporting direction is longer than that of the paper, ink overreaching the front end portion and/or the rear end portion of the paper adheres to the transportation portion. Accordingly, when paper whose length in the paper transporting direction is longer than the transportation portion is then put on the transportation portion, the ink adhering to the transportation portion may be transferred to the non-printing surface (back side) of the paper so as to pollute the paper.

Next, when paper whose length in the paper transporting direction is longer than that of the transportation portion to some extent is transported on the transportation portion, the paper is bent downward in the front and rear portions of the paper in the paper transporting direction so that the vicinities of the front end portion and/or the rear end portion of the paper come in contact with the transportation belts in portions other than the transportation portion. Then, ink which has overreached the front end portion and/or the rear end portion of the paper at the time of zero-margin printing performed previously and which has adhered to a portion other than the transportation portion maybe transferred to the back side of the paper so as to pollute the paper.

The technique of JP-A-2002-211060 does not take into account the use of a plurality of kinds of papers that are different from one another in length in the paper transporting direction. Accordingly, printing can be indeed performed on one kind of paper without pollution with ink, but another kind of paper may be polluted with ink.

Next, since a plurality of transportation belts is disposed in parallel, the width of each transportation belt is inevitably narrowed so that the strength of each transportation belt cannot be secured sufficiently. Accordingly, the lives of the transportation belts are shortened. In addition, inclination of paper with its transportation occurs easily due to the scattering of tension among the transportation belts. Thus, it is difficult to secure good printing quality.

Disclosed herewith is an inkjet printer in which zero-margin printing can be performed on a printing medium with no fear that the non-printing surface of the printing medium is polluted with ink.

Also, disclosed herewith is an inkjet printer in which zero-margin printing can be performed on a printing medium with no fear that the non-printing surface of the printing medium is polluted with ink, while the deterioration in strength of a transportation belt is reduced, and the degree of inclination of the printing medium with its transportation is reduced.

According to an embodiment of the invention, an inkjet printer includes a plurality of rollers, an endless transportation belt, a belt rotating mechanism, a recording unit, a printing medium supply mechanism, and a control unit. The transportation belt is laid on the plurality of rollers and defines a first recess portion, which extends in a direction perpendicular to a printing medium transporting direction, in an outer circumferential surface thereof. The belt rotating mechanism applies a rotating force to the transportation belt. The recording unit is disposed to face the transportation belt and forms an image. The printing medium supply mechanism supplies a printing medium onto the transportation belt. The control unit controls at least one of the belt rotating mechanism and the printing medium supply mechanism so that when the printing medium is on the transportation belt, one of a front end portion and a rear end portion of the printing medium is located in the first recess portion.

With this configuration, zero-margin printing can be performed on a printing medium, while ink overreaching the front end portion or the rear end portion of the printing medium can be prevented from adhering to the transporting surface (a surface of an area excluding the first recess portions) of the transportation belt. The front end portion or the rear end portion of the printing medium can be prevented from being bent downward in the first recess portion and thereby allowing the vicinity of the front end portion or the rear end portion to come in contact with the transportation belt in the first recess portion. Accordingly, ink adhering to the transporting surface of the transportation belt can be prevented from being transferred and attached to the non-printing surface of a printing medium to be printed subsequently. In addition, ink adhering into the first recess portion in zero-margin printing performed previously can be prevented from being transferred and attached to the non-printing surface of the printing medium. Thus, zero-margin printing can be performed on a printing medium with no fear that the non-printing surfaces of the printing media are polluted with ink.

According to the embodiment of the invention, an inkjet printer includes a plurality of rollers, an endless transportation belt, a recording unit, a guide member, projection portions, and ink absorbing members. The transportation belt is laid on the plurality of rollers. The recording unit is disposed to face the transportation belt and forms an image. The guide member is disposed inside the transportation belt. The projection portions project from both side surfaces of the guide member. The guide member and the projection portions define recess portions. The ink absorbing members are disposed in the recess portions, respectively.

DETAILED DESCRIPTION OF THE PREFERRED EMBODIMENT

A preferred embodiment of the invention will be described below with reference to the drawings.

Figure 1:
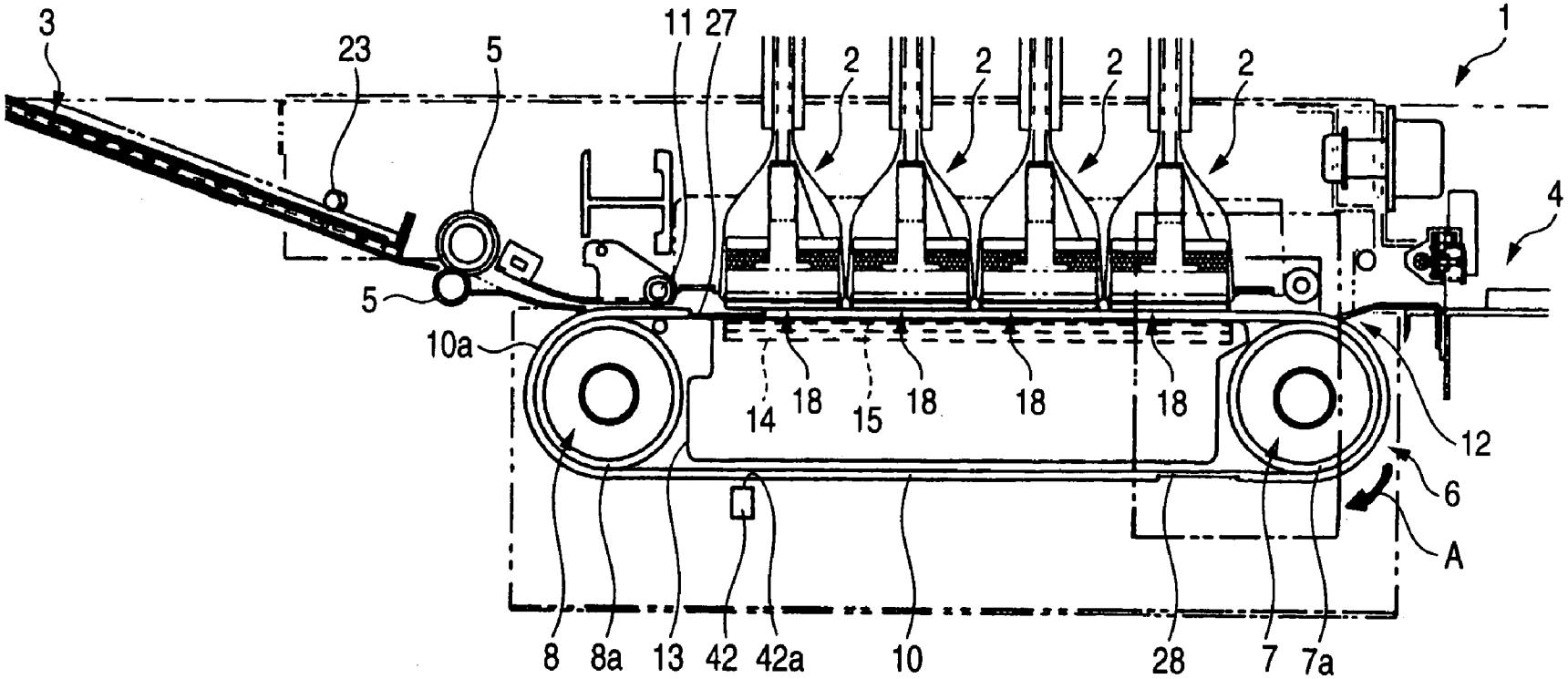
FIG. 1 is a side view showing the whole configuration of an inkjet printer according to an embodiment of the invention.

FIG. 1 is a side view showing the whole configuration of an inkjet printer according to this embodiment. An inkjet printer 1 shown in FIG. 1 is a color inkjet printer having four inkjet heads 2. In this printer 1, a paper supply portion 3 is provided on the left side of FIG. 1, while a paper outlet portion 4 is provided on the right side of FIG. 1.

A paper transportation path flowing from the paper supply portion 3 to the paper outlet portion 4 is formed inside the printer. Just on the downstream side of the paper supply portion 3, a pair of feed rollers 5 are disposed for transporting paper functioning as a printing medium while the paper is retained between the pair of feed rollers 5. In this embodiment, the paper supply portion 3 and the feed rollers 5 function as a printing medium supply mechanism. The pair of feed rollers 5 feeds the paper from the left side to the right side (in the paper transporting direction) in FIG. 1. In the intermediate portion of the paper transportation path, a belt rotating mechanism 6 including two belt rollers 7 and 8, and an endless transportation belt 10 wound and laid between the two rollers 7 and 8 are disposed. Silicone treatment has been performed upon a surface (hereinafter referred to as "transporting surface") 10*a* which is an outer circumferential surface of the transportation belt 10 in an area excluding crosswise grooves 27 and 28 and a longitudinal groove 29 which will be described later. Thus, the paper transported by the pair of feed rollers 5 can be transported to the downstream side (right side) by the clockwise rotating drive (arrow A) of the belt roller 7 as shown in FIG. 1 while the paper is retained on the transporting surface 10*a* of the transportation belt 10 due to the adhesive force of the transporting surface 10*a*.

Figure 3:
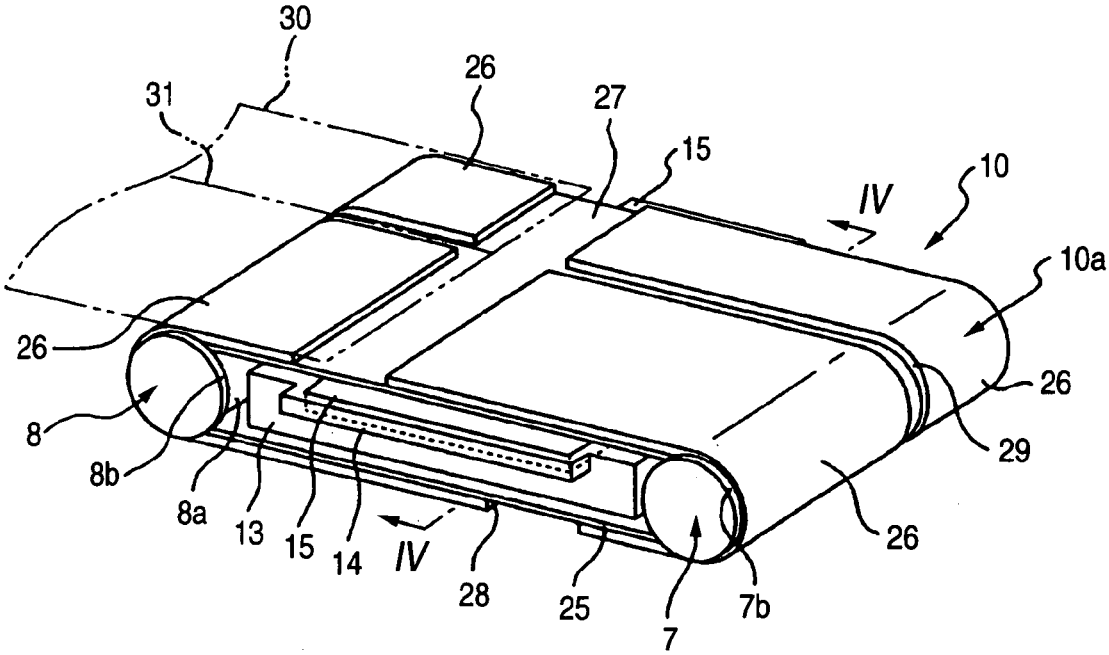
FIG. 3 is a perspective view of a transportation belt included in the inkjet printer shown in FIG. 1.

Each of the two belt rollers 7 and 8 include a cylindrical body 7*a*, 8*a* having an outer circumferential surface in contact with the inner circumferential surface of the transportation belt 10, and flange portions 7*b*, 8*b*. The flange portions 7*b*, 8*b* are provided on both end portions of the cylindrical body 7*a*, 8*a*. The flange portions 7*b*, 8*b* each have a radius substantially as large as a radius made of the thickness of the transportation belt 10 and the radius of the cylindrical body 7*a*, 8*a*, as shown in FIG. 3. Of the two belt rollers 7 and 8 of the belt rotating mechanism 6, the belt roller 7 located on the downstream side of the paper transportation path is connected to a transportation motor, and driven to rotate by a control portion 70 (see FIG. 8), which functions as a control unit, as will be described later. On the other hand, the belt roller 8 located on the upstream side of the paper transportation path is a driven roller rotating due to the rotating force of the transportation belt 10 which force is applied to the transportation belt 10 by the rotation of the belt roller 7. The transportation belt 10 is wound and laid between the belt rollers 7 and 8 while suffering tension from the belt rollers 7 and 8.

Incidentally, a press roller 11 is disposed on a side opposite to the belt roller 8 facing the paper transportation path. The press roller 11 includes a rotatable cylindrical body having a length substantially equal to the longitudinal length of the belt roller 8. The press roller 11 serves to press the paper onto the transporting surface 10*a* of the transportation belt 10 to thereby make the paper adhere onto the transporting surface 10*a* surely without allowing the paper on the transportation belt 10 from floating from the transporting surface 10*a*. In addition, the both end portions of the press roller 11 abut against the flange portions 8*b* of the belt roller 8 respectively so as to prevent the press roller 11 from falling into the crosswise grooves 27 and 28 of the transportation belt 10 (see FIG. 3), which will be described later.

A release mechanism 12 is provided on the right side of the transportation belt 10 in FIG. 1. The release mechanism 12 is designed to release the paper adhering to the transporting surface 10*a* of the transportation belt 10 from the transporting surface 10*a*, and feed the paper toward the paper outset portion 4 on the right side.

Figure 4:
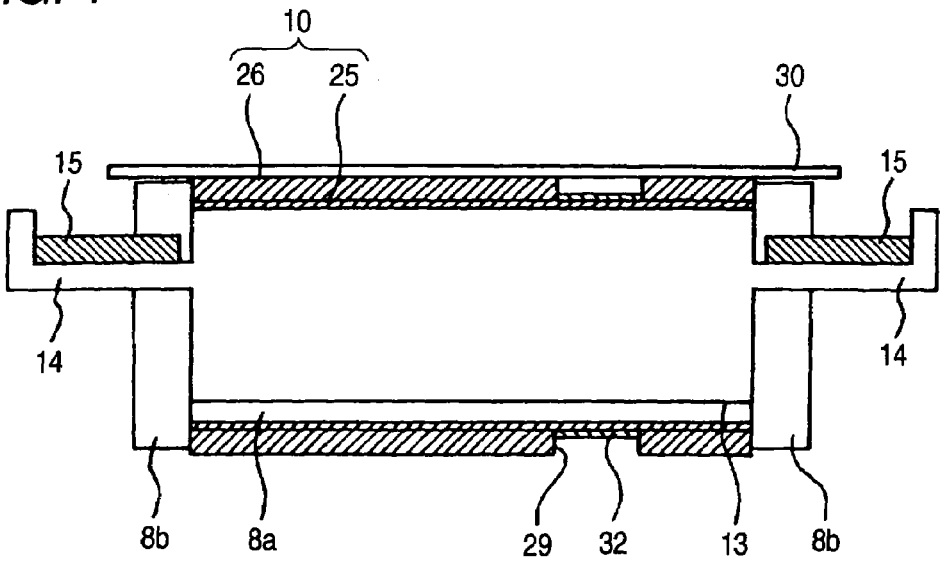
FIG. 4 is a sectional view taken on line A—A in FIG. 3, showing the state where paper having a width larger than the whole width of the transportation belt is transported.

In the region surrounded by the transportation belt 10, a guide member 13 having a substantially rectangular parallelepiped shape (having a width substantially as large as the width of the transportation belt 10 as shown in FIG. 4) is disposed. The guide member 13 abuts against the lower surface of the transportation belt 10 located to face the inkjet heads 2, that is, located on the upper side, so as to support the transportation belt 10 from the inner circumferential side.

A reception member 14 projects from both opposite side surfaces of the guide member 13 and is erected uprightly. The reception member 14 has a length substantially as large as the paper-transporting direction length of an area where the inkjet heads 2 are present. The guide member 13 and the reception member 14 define a recess portion. In the recess portion, an ink absorbing member 15 having a rectangular parallelepiped shape is disposed. In addition, it is preferable that the distance between the top of the ink absorbing member 15 and the surface of each inkjet head 2 facing the paper transportation path is in a range from 6 mm to 8 mm. When the distance is in this range, ink droplets ejected to overreach the paper at the time of zero-margin printing can be prevented easily from floating in the printing and adhering to another member.

Each of four inkjet heads 2 has a head body 18 (including a channel unit where an ink channel including a pressure chamber is formed, and an actuator unit for applying pressure to ink in the pressure chamber, the channel unit and the actuator unit being laminated to each other) in its lower end. Each head body 18 has a rectangular shape in section. The head bodies 18 are disposed adjacently to one another so that their longitudinal directions are perpendicular to the paper transporting direction (direction perpendicular to the paper plane of FIG. 1). That is, the printer 1 is a line type printer. The bottom surfaces of the four head bodies 18 face the paper transportation path. A large number of ink ejection holes 18*a* (see FIG. 2) functioning as nozzles and each having a very small diameter are provided in the bottom surface of each head body 18. Inks of magenta, yellow, cyan and black are ejected from the four head bodies 18, respectively.

Each head body 18 is disposed so that a slight space is formed between the lower surface of the head body 18 and the transporting surface 10*a* of the transportation belt 10. The paper transportation path is formed in the space portion. In this configuration, the respective color inks are ejected from the ejection holes 18*a* toward the upper surface (printing surface) of paper transported on the transportation belt 10 when the paper is passing just under the four head bodies 18 in turn. Thus, a desired color image is formed on the paper.

Figure 2:
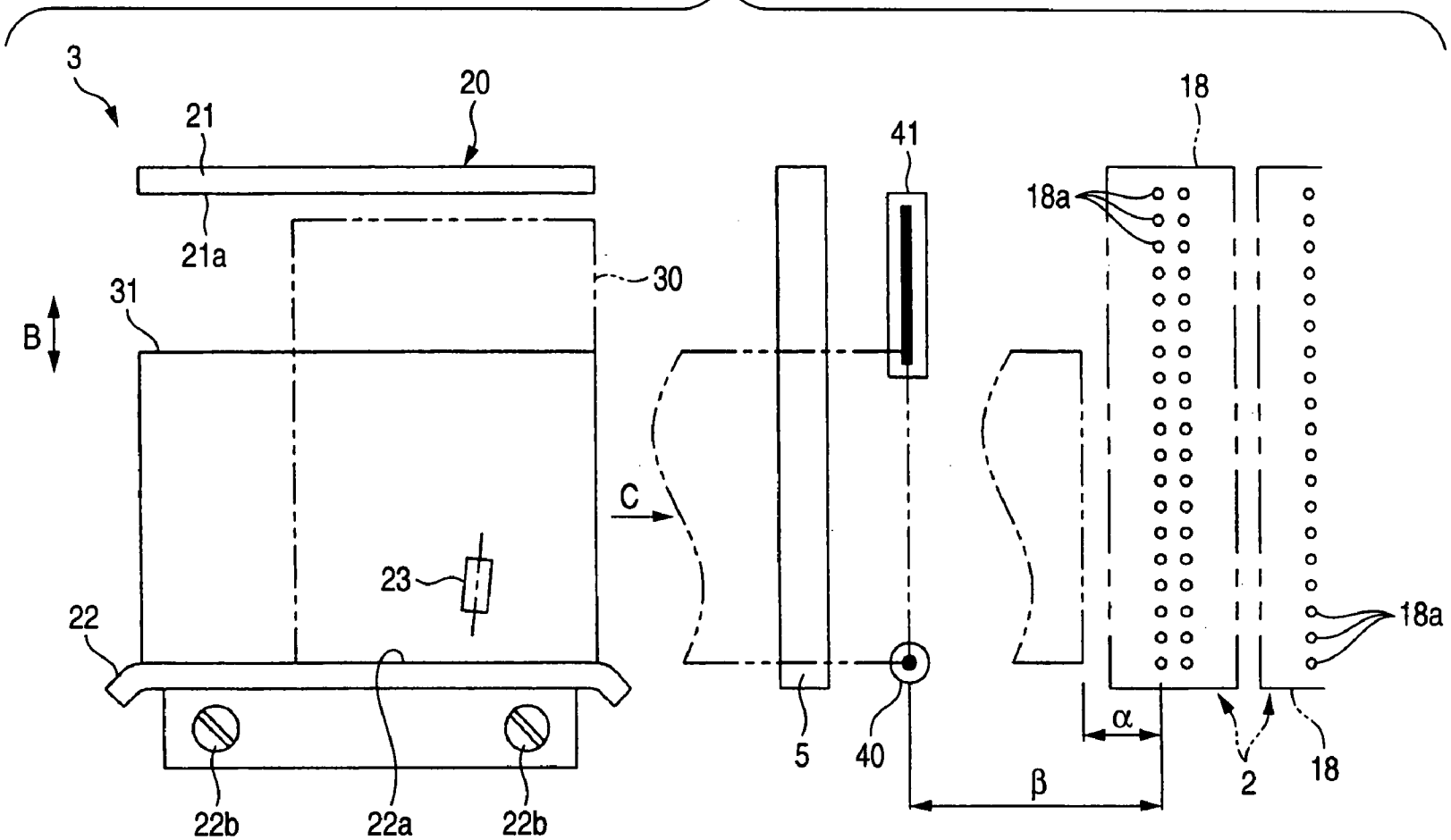
FIG. 2 is a schematic diagram showing the vicinity of a paper set portion included in the inkjet printer shown in FIG. 1.

As shown in FIG. 2, the paper supply portion 3 has a paper set portion 20 and a paper feed roller 23. The paper set portion 20 includes a movable guide 21 sliding in an arrow B in FIG. 2 (the width direction of the transportation belt 10) and a fixed guide 22, which can be adjusted to be parallel to the paper transporting direction (an arrow C direction in FIG. 2). The paper feed roller 23 feeds out the paper toward the feed rollers 5. Then, the movable guide 21 is slid in accordance with the width of paper to be used, so that the paper can be retained between the movable guide 21 and the fixed guide 22. Incidentally, FIG. 2 illustrates two kinds of papers 30 and 31 different in longitudinal and crosswise lengths by way of example.

The movable guide 21 includes a plate-like member having a width in the direction in which a large number of sheets of paper 30, 31 are loaded and overlaid in the paper set portion 20, a thickness in the arrow B direction and a length in the paper transporting direction. The movable guide 21 can move in the arrow B direction while a paper contact surface 21*a* of the movable guide 21 is kept in parallel with the paper transporting direction.

Adjustment holes (not shown) long enough to adjust a paper contact surface 22*a* to be parallel to the paper transporting direction are provided in the fixed guide 22 having an L-shape in section. The paper contact surface 22*a* makes contact with the paper 30, 31. Adjustment screws 22*b* are attached to the adjustment holes, respectively. The adjustment screws 22*b* are loosened to finely adjust the paper contact surface 22*a* in contact with the paper 30, 31 to be parallel to the paper transporting direction, and then, the adjustment screws 22*b* are fastened to fix the fixed guide 22.

The paper feed roller 23 is provided at a position approximately 30 mm distant from the paper contact surface 22*a* of the fixed guide 22 to the center of the paper feed roller 23 and approximately 50 mm distant from the central axis of each feed roller 5 to the center of the paper feed roller 23, and put on the uppermost one of sheets of the paper 30, 31 loaded in the paper set portion 20. The rotating shaft of the paper feed roller 23 tilts clockwise (right handed on the paper plane of FIG. 2) at an angle of 3° with respect to a direction perpendicular to the paper transporting direction in which the paper 30, 31 is transported, as shown in FIG. 2.

The paper feed roller 23 configured thus is driven by a first paper feed motor 79 (see FIG. 8) so as to feed the paper 30, 31 toward the feed rollers 5. In addition, before the paper front end portion reaches the feed rollers 5, the paper 30, 31 is forcibly made to approach the fixed guide 22. Thus, one width-direction end portion of the paper 30, 31 comes into contact with the paper contact surface 22*a* of the fixed guide 22 so as to be made parallel to the paper transporting direction. Then, the paper 30, 31 is retained between the feed rollers 5, and transported onto the transportation belt 10.

In this embodiment, the rotating shaft of the paper feed roller 23 tilts at an angle of 3° as described above. It is therefore unnecessary to stop the paper transportation to correct the skew of the paper. Thus, the paper can be transported continuously. Further, there can be obtained an advantage that the paper can be transported without suffering any excessive force for correcting the skew of the paper and without bending even when the paper is brittle and thin.

The transportation belt 10 has a two-layer structure in which inside and outside sheet-like members 25 and 26 are laminated to each other as shown in FIG. 4. The inside sheet-like member 25 is made from non-woven fabric impregnated with polyurethane. However, the material of the inside sheet-like member 25 is not limited especially. For example, woven or non-woven fabric impregnated with polyester or the like may be used. The outside sheet-like member 26 is made from silicon rubber. However, the material of the outside sheet-like member 26 is not limited especially. For example, rubber materials such as EPDM, urethane rubber, butyl rubber, and the like, may be used. Incidentally, in this embodiment, the inside sheet-like member 25 is 0.2 mm thick, and the outside sheet-like member 26 is 1.5 mm thick. The outside sheet-like member 26 is thus thicker than the inside sheet-like member 25. Incidentally, although the inside and outside sheet-like members 25 and 26 used in this embodiment are 0.2 mm and 1.5 mm thick, respectively, their thicknesses are not limited especially as long as the outside sheet-like member is thicker than the inside sheet-like member.

As shown in FIG. 3, a part of the inside sheet-like member 25 is not covered with the outside sheet-like member 26.

Thus, two crosswise grooves 27 and 28, which function as first recess portions, and one longitudinal groove 29, which function as second recess portion, each having a height as large as the thickness of the outside sheet-like member 26 are provided in the outer circumference of the transportation belt 10. Incidentally, in the inkjet printer 1 in this embodiment, as will be described later, the timing at which paper is fed out by the feed rollers 5 is controlled to allow the front end portion of the paper to be located in the crosswise groove 27 regardless of the length of the paper.

On the outer circumferential surface of the transportation belt 10, the two crosswise grooves 27 and 28 are provided in the width direction (direction perpendicular to the paper transporting direction) of the transportation belt 10 so as to extend over the width of the transportation belt 10 as shown in FIG. 3. Further, on the outer circumferential surface of the transportation belt 10, the longitudinal groove 29 is provided in the paper transporting direction so as to extend over the circumference of the transportation belt 10. Each crosswise groove 27, 28 is connected to the longitudinal groove 29 in the portion where the crosswise groove 27, 28 and the longitudinal groove 29 cross each other. Incidentally, the chain double-dashed lines shown in FIG. 3 designate the paper 30 having a width larger than the whole width of the transportation belt 10 and the paper 31 having a width smaller than the width of the transportation belt 10. In addition, the paper-transporting direction length of the paper 31 is longer than that of the paper 30 and substantially as long as the circumferential length of the transportation belt 10.

When the paper 30, 31 shown by the chain double-dashed lines is transported onto the transportation belt 10, the front end portion of the paper 30, 31 is positioned in the crosswise groove 27 of the two crosswise grooves 27 and 28, the crosswise groove 27 being located on the upper side of the transportation belt 10 in the state shown in FIG. 3. Then, when the crosswise groove 28 located on the lower side in the state shown in FIG. 3 moves to the upper side, the rear end portion of the paper 30 is positioned in the crosswise groove 28. On the other hand, the rear end portion of the paper 31 is positioned in the crosswise groove 27 in the same manner as the front end portion of the paper 31. The width of the crosswise grooves 27, 28 in the paper-transporting direction may be slightly larger than that of one of the four inkjet heads 2 in the paper-transporting direction. If so configured, the crosswise grooves 27, 28 can be used as a groove for a so-called flushing operation.

In such a manner, the crosswise grooves 27 and 28 are provided so that the front end portion and the rear end portion of the paper 30, 31 are positioned in the crosswise grooves 27 and 28. Accordingly, when zero-margin printing is performed on any paper 30, 31, ink droplets overreaching the front end portion and the rear end portion of the paper 30, 31 can be caught by the crosswise grooves 27 and 28. That is, since ink does not adhere to the transporting surface 10*a* of the transportation belt 10, there is no fear that ink is transferred from the transporting surface 10*a* to the back side of paper to be printed subsequently. In addition, there is no fear that the front end portion and the rear end portion of the paper 30, 31 are bent downward in the crosswise grooves 27 and 28 to thereby come into contact with the bottom portions of the crosswise grooves 27 and 28. Thus, there is no fear that ink adhering to the crosswise grooves 27 and 28 due to zero-margin printing performed previously is transferred and attached to the back side of the paper 30, 31.

In addition, the paper 30 transported onto the transportation belt 10 is disposed so that the both side portions of the paper 30 along the paper transporting direction overreach the both side portions of the transportation belt 10 along the paper transporting direction as shown in FIG. 4. Accordingly, there is no fear that ink overreaching the both side portions of the paper 30 pollutes the transporting surface 10*a* even if ink droplets are ejected in a print area a little larger than the paper size when zero-margin printing of a desired image is performed on the paper 30 by the ink droplets ejected from the inkjet heads 2.

When ink droplets are ejected in a print area larger than the paper size, the ink droplets overreaching the front end portion and the rear end portion of the paper 30 are caught by the crosswise grooves 27 and 28. The ink droplets overreaching the both side portions of the paper 30 are absorbed by the ink absorbing member 15 disposed in the reception member 14 projecting from the side surfaces of the guide member 13 as described above.

Figure 5:
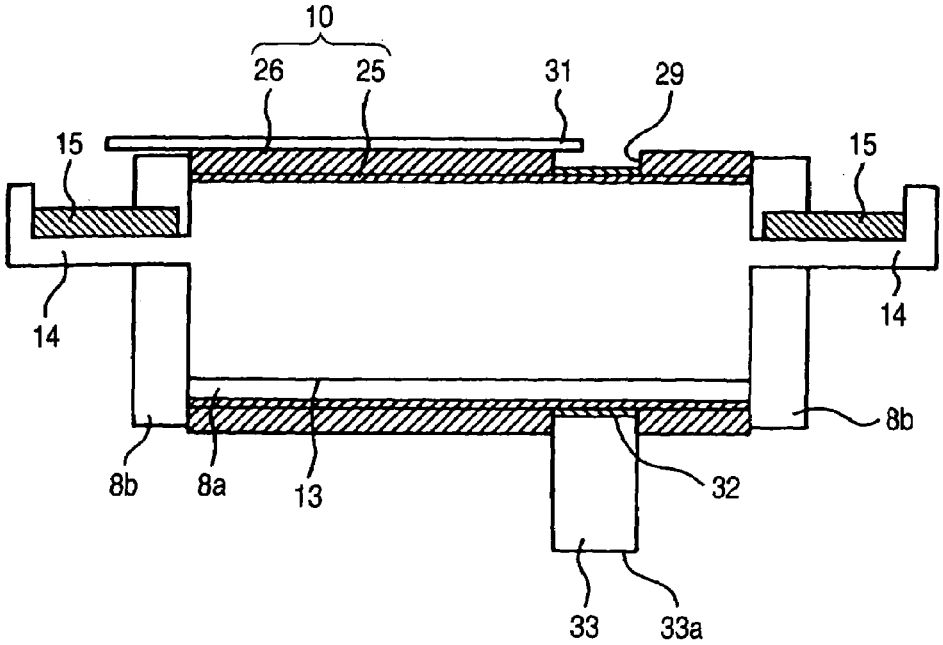
FIG. 5 is a sectional view taken on line A—A in FIG. 3, showing the state where paper having a width smaller than the whole width of the transportation belt is transported.

On the other hand, the paper 31 having a width smaller than the whole width of the transportation belt 10 is disposed so that one of the both side portions of the paper 31 in the paper transporting direction is positioned in the longitudinal groove 29, while the other side portion of the paper 31 overreaches one side portion of the transportation belt 10, as shown in FIG. 5. Accordingly, there is no fear that ink overreaching the both side portions of the paper 31 pollutes the transporting surface 10*a* even if ink droplets are ejected in a print area a little larger than the paper size when zero-margin printing of a desired image is performed on the paper 31 by the ink droplets ejected from the inkjet heads 2. Thus, there is no fear that ink adhering to the transporting surface 10*a* of the transportation belt 10 is transferred and attached to the back side of paper to be printed subsequently.

In addition, there is no fear that one side portion of the paper 31 is bent downward in the longitudinal groove 29 so as to allow the vicinity of the side portion of the paper 31 to come into contact with the transportation belt 10 in the longitudinal groove 29. Thus, there is no fear that ink adhering into the longitudinal groove 29 due to zero-margin printing performed previously is transferred and attached to the back side of the paper 31.

In addition, a sheet-like ink absorbing member 32 thinner than the outside sheet-like member 26 is disposed on the bottom surface of each of the crosswise grooves 27 and 28 and the longitudinal groove 29. The material of the ink absorbing member 32 is urethane foam, which includes a plurality of microcavity portions inside. In addition, the ink absorbing member 15 is also made from similar urethane foam.

Since the ink absorbing members 32 are thus disposed on the bottom surfaces of the crosswise grooves 27 and 28 and the longitudinal groove 29, it is possible to absorb ink droplets which overreach the front end portion and rear end portion of the paper 30, 31 and one end portion of the paper 31 located in the longitudinal groove 29, and which are ejected to the bottom surfaces of the crosswise grooves 27 and 28 and the longitudinal groove 29. Thus, the ink droplets ejected from the inkjet heads 2 can be prevented from rebounding from ink staying in the respective grooves, and thereby polluting the transporting surface 10*a* of the transportation belt 10 or the lower surface of the paper 30, 31 located in the crosswise grooves 27 and 28 and the longitudinal groove 29.

In addition, as shown in FIG. 5, a columnar cleaning roller 33 whose outer circumferential portion is located in the longitudinal groove 29 and which can rotate around a central shaft is provided in the inkjet printer 1. An ink absorbing member made frog urethane foam is provided in the outer circumferential portion of the cleaning roller 33. The cleaning roller 33 is disposed at a position where an outer circumferential surface 33*a* of the cleaning roller 33 abuts against the ink absorbing member 32 serving as the bottom surface of the longitudinal groove 29. As a result, when the transportation belt 10 is moved cyclically in the paper transporting direction by the rotations of the belt rollers 7 and 8, the cleaning roller 33 also rotates due to the frictional force between the outer circumferential surface 33*a* of the cleaning roller 33 and the ink absorbing member 32. Thus, ink in the crosswise grooves 27 and 28 and the longitudinal groove 29 can be drained by the capillary force from the cleaning roller 33.

That is, the crosswise grooves 27 and 28 are connected with the longitudinal groove 29, and the ink absorbing members 32 disposed on the bottom surfaces of the respective grooves are connected with each other. Accordingly, when the cleaning roller 33 absorbs ink from the ink absorbing member 32 located in the longitudinal groove 29 and impregnated with the ink, ink in the ink absorbing members 32 in the crosswise grooves 27 and 28 are attracted toward the ink absorbing member 32 in the longitudinal groove 29 by the capillary force. Finally, the ink penetrating the ink absorbing members 32 in the respective recess portions can be drained by the cleaning roller 33.

Incidentally, the capillary force used herein means a force of attracting and moving ink from another part of an ink absorbing member to one part thereof when ink stored in the one part of the ink absorbing member is absorbed, or a force of making ink absorbed into an absorber for absorbing ink when the absorber is brought into contact with a part of an ink absorbing member collecting the ink.

In addition, the cleaning roller 33 is brought into contact with not-shown waste liquid foam. The ink penetrating the cleaning roller 33 is sucked to the waste liquid foam by the capillary force of the waste liquid foam. Thus, the ink penetrating the cleaning roller 33 can be drained.

The cleaning roller 33 is not limited especially. The cleaning roller 33 may have a mechanism for temporarily abutting against the ink absorbing member 32 in the longitudinal groove 29. That is, the cleaning roller 33 may be any mechanism so long as the mechanism is capable of draining ink from the ink absorbing members 32 in the respective recess portions. When such a mechanism is provided, ink can be drained from the ink absorbing members 32 in the respective grooves up to the ink volume capable of penetrating the waste liquid foam. Further, when a mechanism for draining the ink penetrating the waste liquid foam to the outside of the inkjet printer 1, ink ejected to the ink absorbing members 32 in the respective recess portions can be drained without any limitation.

In addition, the shape of each groove in the transportation belt 10 is not limited to the aforementioned one. For example, according to modifications of this embodiment, transportation belts 60, 65, 60*a*, and 65*a* may be formed as shown in FIG. 6A to 6D. Each transportation belt 60, 65, 60*a*, 65*a* has a two-layer structure in which an inside sheet-like member and an outside sheet-like member are laminated to each other in the same manner as the transportation belt 10. That is, crosswise grooves and longitudinal grooves are provided in portions where the inside sheet-like member is not covered with the outside sheet-like member. Incidentally, FIGS. 6A to 6D are plan views of the transportation belts. In fact, the transportation belts 60, 65, 60*a* and 65*a* are endless belts.

Figure 6A:
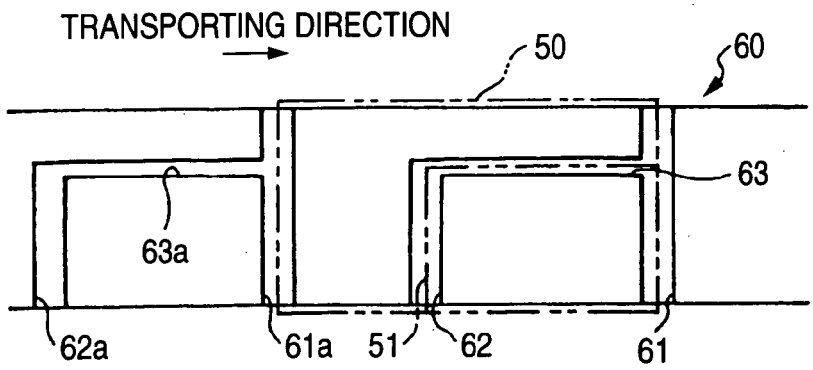
FIG. 6A is a plan view showing a modification of the transportation belt.

The transportation belt 60 shown in FIG. 6A has crosswise grooves 61 and 62 and a longitudinal groove 63. The crosswise groove 61 allows the front end portion of paper 50 and the front end portion of paper 51 to be located therein. The paper 50 is shown by the chain double-dashed line in FIG. 6A and has a width larger than the whole width of the transportation belt 60, and the paper 51 has dimensions smaller both crosswise and lengthwise than those of the paper 50. The crosswise groove 62 allows the rear end portion of the paper 51 to be located therein. When one of the width-direction both side end portions of the paper 51 is disposed to overreach one side portion of the transportation belt 60, the other side end portion of the paper 51 is located in the longitudinal groove 63.

The crosswise groove 61 is provided in the width direction of the transportation belt 60 so as to extend over the width of the transportation belt 60. On the other hand, the crosswise groove 62 is provided in the width direction of the transportation belt 60 so as to extend from one side portion of the transportation belt 60 to the intersection with the longitudinal groove 63. The longitudinal groove 63 is provided in parallel to the paper transporting direction so as to cross one end portion of the crosswise groove 62. The lengths of the respective grooves in the width direction of the transportation belt 60 and in the paper transporting direction are set in accordance with the lengths between the front and rear end portions of the papers 50 and 51 and the lengths between the width-direction both side portions of the papers 50 and 51.

In addition, grooves 61*a*, 62*a* and 63*a* similar to the grooves 61 to 63, respectively, are formed on the upstream side (left in FIG. 6A) of the transportation belt 60. Of the grooves 61*a*, 62*a* and 63*a*, the crosswise groove 61*a* is provided to allow the rear end portion of the paper 50 to be located therein. The crosswise groove 61*a* allows the rear end portion of the paper 50 to be located therein while also allowing the front end portion of paper transported subsequently to be located therein.

Figure 6B:
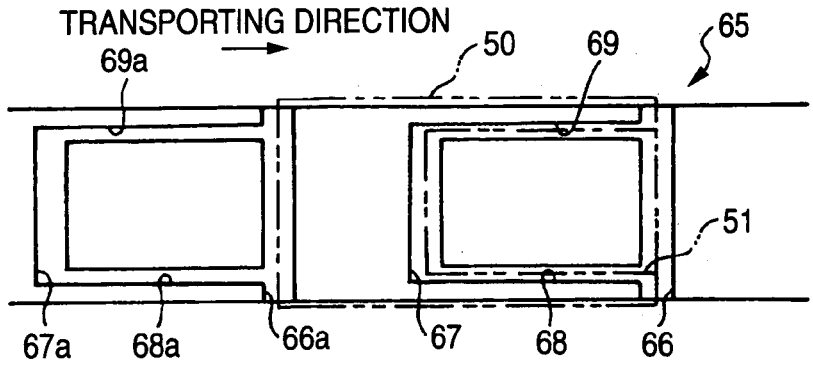
FIG. 6B is a plan view showing a modification of the transportation belt.

The transportation belt 65 shown in FIG. 6B includes crosswise grooves 66 and 67 and longitudinal grooves 68 and 69. The crosswise groove 66 allows the front end portions of the papers 50 and 51 to be located therein. The crosswise groove 67 allows the rear end portion of the paper 51 to be located therein. The longitudinal grooves 68 and 69 allow the width-direction both side portions of the paper 51 to be located therein, respectively.

The crosswise groove 66 is provided in the width direction of the transportation belt 65 so as to extend over the width of the transportation belt 65. On the other hand, the crosswise groove 67 is provided in the width direction of the transportation belt 65 so as to extend from a position distant from the both side portions of the transportation belt 65. The crosswise groove 67 is connected with one end portion of each longitudinal groove 68, 69. Each longitudinal groove 68, 69 is provided in parallel to the paper transporting direction so as to connect a halfway position of the crosswise groove 66 with an end portion of the crosswise groove 67. The lengths of the respective grooves in the width direction of the transportation belt 65 and in the paper transporting direction are set in accordance with the lengths between the front and rear end portions of the papers 50 and 51 and the lengths between the width-direction both side portions of the papers 50 and 51.

In addition, grooves 66*a*, 67*a*, 68*a* and 69*a* similar to the grooves 66 to 69, respectively, are formed on the upstream side (left in FIG. 6B). Of the transportation belt 65 of the grooves 66*a*, 67*a*, 68*a* and 69*a*, the crosswise groove 66*a* is provided to allow the rear end portion of the paper 50 to be located therein. The crosswise groove 66*a* allows the rear end portion of the paper 50 to be located therein while also allowing the front end portion of paper transported subsequently to be located therein.

Figure 6C:
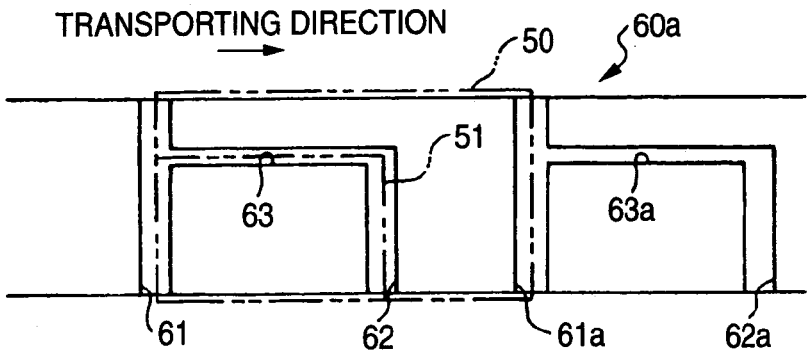
FIG. 6C is a plan view showing a modification of the transportation belt.

In the transportation belt 60*a* shown in FIG. 6C, the upstream and downstream positions of the grooves 62, 63, 62*a* and 63*a* provided in the transportation belt 60 in FIG. 6A are replaced with each other symmetrically with respect to the crosswise grooves 61 and 61*a*. On the other hand, in the transportation belt 65*a* shown in FIG. 6D, the upstream and downstream positions of the grooves 67, 68, 69, 67*a*, 68*a* and 69*a* provided in the transportation belt 65 in FIG. 6B are replaced with each other symmetrically with respect to the crosswise grooves 66 and 66*a*. Incidentally, grooves of each transportation belt 60, 65, 60*a*, 65*a* are not limited especially. Other grooves may be added in accordance with the number of kinds of papers to be used. For example, grooves may be added in accordance with various paper sizes such as a postcard size, a B5 size, an A4 size and the like.

Of the transportation belts 60, 65, 60*a* and 65*a*, the transportation belts 60 and 60*a* shown in FIGS. 6A and 6C are suitable for application to an inkjet printer 1 using a paper supply portion 3 for making the two kinds of papers 50 and 51 approach one side portion of the transportation belt 60, 60*a* to thereby make the papers 50 and 51 be parallel to the paper transporting direction. On such a transportation belt 60, 60*a*, each paper 50, 51 is transported while each paper 50, 51 overreaches one side portion of the transportation belt 60, 60*a*. Accordingly, the number of longitudinal grooves 63 and 63*a* to be provided can be reduced. That is, when zero-margin printing is performed on the paper 51 having a width smaller than the whole width of the transportation belt 60, 60*a*, one of the both side portions of the paper 51 in the paper transporting direction overreaches one side portion of the transportation belt 60, 60*a*. It is therefore unnecessary to provide a longitudinal groove where the one side portion of the paper should be located. Thus, the number of longitudinal grooves can be reduced. As a result, the deterioration in strength of the transportation belt 60, 60*a* can be reduced. In addition, differently from the transportation belt in JP-A-2002-211060, the transportation belt is not divided into a plurality of belts. Accordingly, the strength of the transportation belt is comparatively high, and the degree of inclination of the paper 50, 51 with its transportation can be reduced.

Figure 6D:
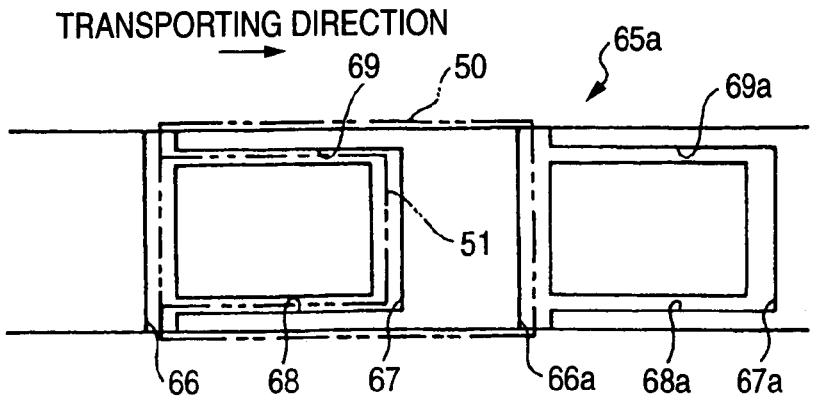
FIG. 6D is a plan view showing a modification of the transportation belt.

On the other hand, the transportation belts 65 and 65*a* shown in FIGS. 6B and 6D are suitable for application to an inkjet printer using a paper supply portion 3 for making the two kinds of papers 50 and 51 approach the width-direction center of the transportation belt 65, 65*a* to thereby make the papers 50 and 51 be parallel to the paper transporting direction. Also in such a transportation belt 65, 65*a*, there is no fear that ink overreaching the paper 50, 51 adheres to the transporting surface of the transportation belt 65, 65*a* when zero-margin printing is performed.

In each of inkjet printers having the transportation belts 60, 65, 60*a* and 65*a* shown in FIGS. 6A–6D, the front end portion or the rear end portion of each of the two kinds of papers 50 and 51 different in paper-transporting direction length from each other is always located in the specific crosswise groove 61, 61*a*, 66, 66*a*. Thus, the number of crosswise grooves can be minimized. Accordingly, the deterioration in strength of the transportation belt 60, 65, 60*a*, 65*a* can be reduced. In addition, differently from the transportation belt in JP-A-2002-211060, the transportation belt is not divided into a plurality of belts. Accordingly, the strength of the transportation belt is comparatively high, and the degree of inclination of the paper 50, 51 with its transportation can be reduced.

In addition, each crosswise groove 61, 61*a*, 66, 66*a* is provided to extend over the width of the transportation belt. Accordingly, when zero-margin printing is performed on the paper 50, ink droplets overreaching the front end portion and the rear end portion of the paper 50 can be caught by the crosswise grooves 61 and 61*a* or 66 and 66*a*, respectively. Thus, the ink droplets are prevented from adhering to the transporting surface of the transportation belt 60, 65, 60*a*, 65*a*.

Further, the crosswise groove 62, 62*a*, 67, 67*a* has a length corresponding to the width of the paper 51. Accordingly, the crosswise groove 62, 62*a*, 67, 67*a* is not longer than necessary. Thus, the deterioration in strength of the transportation belt is small.

In addition, in the inkjet printer 1 according to this embodiment, a first paper surface sensor 40 and a second paper surface sensor 41 as shown in FIG. 2 are disposed at positions where the first and second paper surface sensors 40 and 41 can detect the upper surface of the paper 30, 31 between the feed rollers 5 and the press roller 11 in order to feed the paper 30, 31 at a proper timing and thereby position the front end portion of the paper 30, 31 in the crosswise groove 27 of the transportation belt 10. In addition, a transportation belt position detection sensor 42 for detecting the positions of the crosswise grooves 27 and 28 is provided at a position under the transportation belt 10 and close to the belt roller 8 as shown in FIG. 1.

The first paper surface sensor 40 is provided on the fixed guide 22 side. The first paper surface sensor 40 has a small circular detection range for detecting one corner portion of the front end portion of the paper 30, 31 made to approach the fixed guide 22 and fed in parallel to the paper transporting direction. On the other hand, the second paper surface sensor 41 is provided on the movable guide 21 side to detect the other corner portion of the front end portion of the paper 30, 31 fed in parallel to the paper transporting direction. The second paper surface sensor 41 has a rectangular detection range that extends parallel to the width direction of the transportation belt 10.

When the two kinds of papers 30 and 31 are fed from the paper supply portion 3, each paper is made to approach the fixed guide 22 by the paper feed roller 23. Therefore, one corner portion of the front end portion of the paper 30, 31 passes through a substantially fixed place in the detection range of the first paper surface sensor 40. By detecting the corner portion, the position of the paper 30, 31 can be detected. At the same time, the other corner portion of the paper 30, 31 is detected by the second paper surface sensor 41. Thus, the paper size and the parallelism of the paper 30, 31 to the paper transporting direction can be detected.

The transportation belt position detection sensor 42 is disposed on one side of the transportation belt 10 in the width direction of the transportation belt 10. The transportation belt position detection sensor 42 detects a difference between the distance from a detection surface 42*a* of the transportation belt position detection sensor 42 facing the transportation belt 10 to the transporting surface 10*a* of the transportation belt 10 and the distance from the detection surface 42*a* to the bottom surface of the crosswise groove 27, 28. Thus, the crosswise groove 27, 28 provided to extend all over the width of the transportation belt 10 is detected.

As soon as the first and second paper surface sensors 40 and 41 detect the paper 30, 31, the paper transportation by the feed rollers 5 is suspended. Then, as soon as the transportation belt position detection sensor 42 detects the crosswise groove 27, the feed rollers 5 resume their rotations at a timing to allow the front end portion of the paper 30, 31 to be located in the crosswise groove 27 so that the paper 30, 31 is fed out. The paper 30, 31 fed onto the transportation belt 10 is discharged from the paper outlet portion 4 after zero-margin printing is performed on the paper 30, 31. Incidentally, the control portion 70 shown in FIG. 8 makes control to rotate the feed rollers 5 at a proper timing to feed out the paper 30, 31.

Figure 7B:
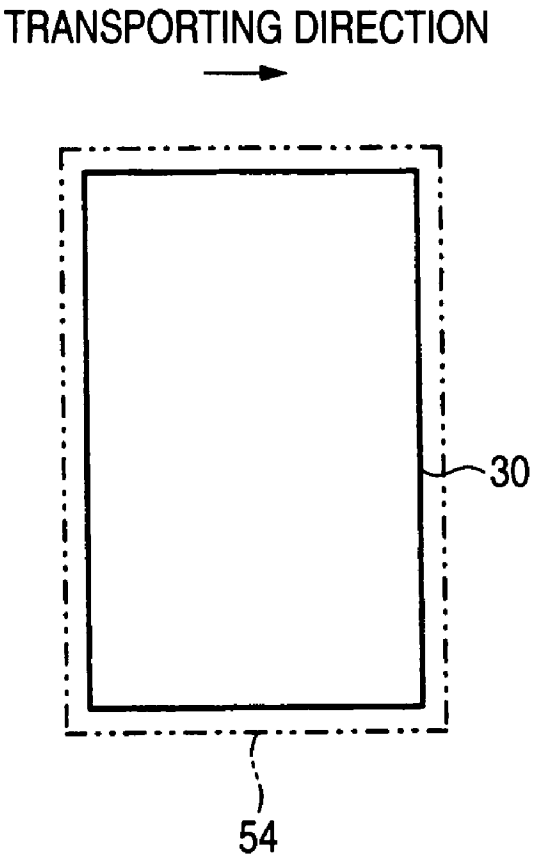
FIG. 7B is a schematic view depicting a print area in zero-margin printing with the inkjet printer shown in FIG. 1.
Figure 7A:
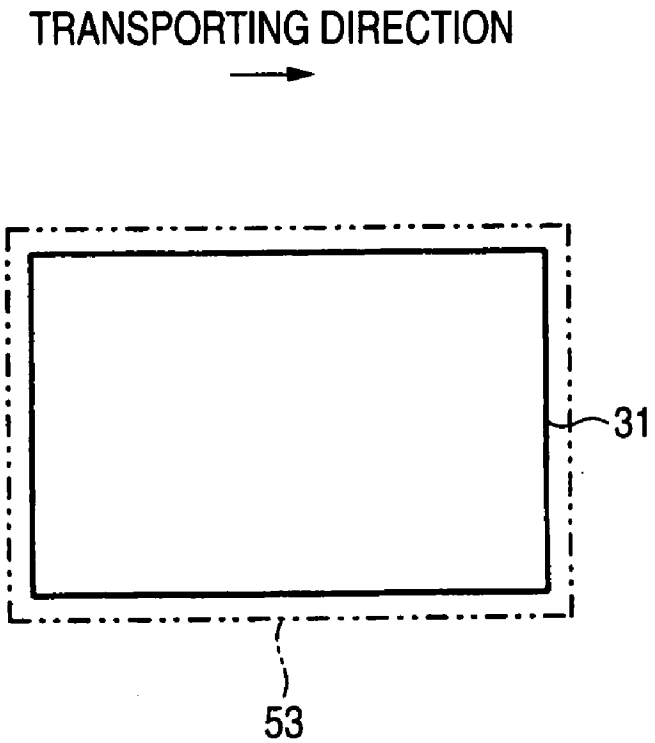
FIG. 7A is a schematic view depicting a print area in zero-margin printing with the inkjet printer shown in FIG. 1.

When normal printing (with a margin left in a circumferential portion of paper) is performed on the paper 30, 31, an area (not shown) one size smaller than the paper size of the paper 30, 31 is set as the print area. On the other hand, the print area (ink ejection area) in zero-margin printing is an area 53, 54 one size larger than the paper size of the paper 30, 31 as shown in FIG. 7A, 7B. Here, the area 53, 54 is obtained by expanding the size of the paper 30, 31 by a distance $\alpha$ (e.g. about 1 mm) in each of upward, downward, leftward and rightward directions.

In normal printing, ink ejection from the ink ejection holes 18*a* is started as soon as the paper 30, 31 shown in FIG. 2 is transported from the position where the paper 30, 31 has been detected by the sensors 40 and 41, and moved by a distance $\beta$ (corresponding to the distance between the sensor 40, 41 and the ink ejection hole 18*a* of the head body 18 the closest to the sensor 40, 41).

On the other hand, in zero-margin printing, ink ejection from the ink ejection holes 18*a* is started as soon as the paper 30, 31 shown in FIG. 2 is transported from the position where the paper 30, 31 has been detected by the sensors 40 and 41, and moved by a distance $(\beta-\alpha)$. In such a manner, zero-margin printing can be performed surely on the paper 30, 31 without leaving any margin in the circumference of the paper.

Incidentally, the paper size is detected as soon as the paper passes through the sensor 40, 41. Then, the size of the print area and the print start timing for performing printing on the paper are determined on the basis of the paper size detected at that time and the printing mode (that is, the normal printing mode or the zero-margin printing mode). When the size of the print area is determined, the control portion 70 shown in FIG. 8 performs processing for scaling up/down image data to be printed in accordance with the determined size.

Figure 8:
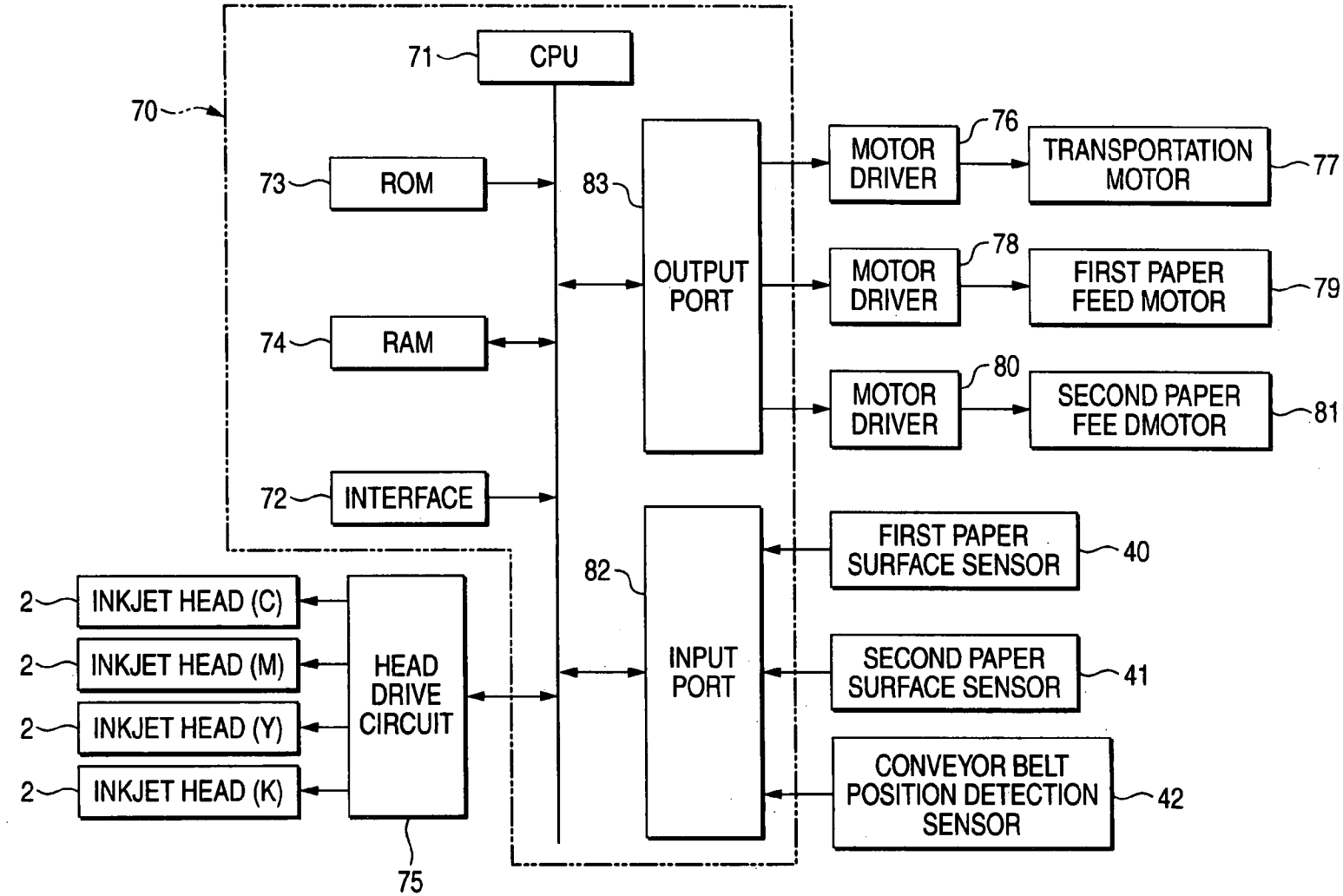
FIG. 8 is a block diagram showing a control system of the inkjet printer shown in FIG. 1.

Next, a control system of the inkjet printer 1 will be described with reference to the schematic block diagram shown in FIG. 8. As shown in FIG. 8, the control portion 70 included in the inkjet printer 1 has a CPU (Central Processing Unit) 71, an interface 72, a ROM 73, a RAM 74, an input port 82 and an output port 83. In the inkjet printer 1, the CPU (Central processing Unit) 71 included in the control portion 70 operates along a control program stored in the ROM 73 in accordance with a print instruction signal inputted through the interface 72, so as to control printing operations such as paper supply, paper conveyance, paper discharge, ink ejection, and so on.

The CPU 71 performs various kinds of processing using the RAM 74 in accordance with necessity. In addition, the CPU 71 receives print data from the outside (for example, a personal computer or the like) through the interface 72, creates print image data using image data or the like stored in the ROM 73 in accordance with necessity, and stores the created print image data into the RAM 74.

Then, the CPU 71 drives the first paper feed motor 79 through a motor driver 78, the second paper feed motor 81 through a motor driver 80, and the transportation motor 77 through a motor driver 76. The first paper feed motor 79 is connected to the paper feed roller 23 by which the paper 30, 31 loaded in the paper set portion 20 is fed out in parallel to the paper transporting direction. The second paper feed motor 81 is connected to the feed rollers 5 for feeding the paper 30, 31 onto the transportation belt 10. The transportation motor 77 is connected to the belt roller 7 for applying a rotating force to the transportation belt 10. In addition, the four inkjet heads 2 are driven through a head drive, circuit 75 individually so as to print an image corresponding to the print image data. Incidentally, the first paper surface sensor 40, the second paper surface sensor 41, the transportation belt position detection sensor 42 and so on as described above are also connected to the CPU 71 through the input port 82. The CPU 71 performs predetermined processing in accordance with detection signals from these sensors.

Next, description will be made on an example of zero-margin printing operation on paper in the inkjet printer 1. First, the movable guide 21 is slid toward the fixed guide 22 while a plurality of sheets of paper 31 are loaded in the paper set portion 20 of the paper supply portion 3. Thus, the paper 31 is set so that the width-direction on both side portions of the paper 31 are parallel to the paper transporting direction. In this event, the paper feed roller 23 is in contact with the upper surface of the paper 31.

Next, a print instruction is transmitted from a personal computer or the like to the CPU 71 through the interface 72. The paper feed roller 23 feeds the paper 31 at the top in the paper transporting direction in response to the print instruction. The paper 31 fed by the paper feed roller 23 is made to approach the fixed guide 22 to be made be parallel to the paper transporting direction, and sent between the paired feed rollers 5. Then, the feed rollers feed the paper 31 to a position where the first and second paper surface sensors 40 and 41 detect both corner portions of the front end portion of the paper 31. Incidentally, the print instruction includes paper size data in advance. The CPU 71 checks the paper size data with the detection signals from the paper surface sensors 40 and 41, to confirm whether the paper 31 has been transported in parallel, and recognize the front end portion position of the paper 31. In addition, the feed rollers 5 feed the paper 31 while the transportation belt position detection sensor 42 detects the positions of the crosswise grooves 27 and 28 of the transportation belt 10.

Next, driving the second paper feed motor 81 is started at the timing at which the front end portion of the paper 31 will be located in the crosswise groove 27. Thus, the feed rollers 5 start rotating to feed the paper 31 in parallel to the paper transporting direction. Then, the paper 31 fed out is fed in the paper transporting direction on the transportation belt 10 in the state where the paper 31 is made to adhere to the transporting surface 10*a* of the transportation belt 10 by the press roller 11.

Incidentally, since the paper 31 is made to approach the fixed guide 22 by the paper feed roller 23 when the paper 31 is fed onto the transportation belt 10, one of the width-direction both side portions of the paper 31 overreaches one side portion of the transportation belt 10.

Thus, the paper 31 is transported downstream while adhering to the transporting surface 10*a* of the transportation belt 10. Then, as soon as the paper 31 is fed by the distance $(\beta-\alpha)$ from the position where the paper 31 is detected by the sensors 40 and 41, the CPU 71 starts driving the inkjet head 2, which is one of the four inkjet heads 2 and is located in an upstream position through the head drive circuit 75. Thus, ink droplets are ejected onto the print area 53 so that zero-margin printing is performed on the paper 31. Incidentally, the paper 30 is transported on the transportation belt 10 in the same manner as the paper 31, and ink droplets are ejected on the print area 54 so that zero-margin printing is performed.

Ink droplets overreaching each end portion of the paper 31 are absorbed by the ink absorbing members 32 disposed in the grooves 27 to 29 of the transportation belt 10 and the ink absorbing member 15 disposed in the guide member 13. The paper 31 subjected to zero-margin printing thus is released from the transporting surface 10*a* by the release mechanism 12, and then discharged from the paper outlet portion 4. Zero-margin printing is performed also on the paper 30 in the same manner.

As described above, in the inkjet printer 1 according to this embodiment, the crosswise grooves 27 and 28 are provided in the transportation belt 10, and the paper 30, 31 is fed onto the transportation belt 10 at proper timing. Thus, zero-margin printing can be performed on the two kinds of papers 30 and 31 different from each other in length in the paper transporting direction without polluting the back sides of the papers 30 and 31 with ink.

In addition, the longitudinal groove 29 is provided. Accordingly, even when zero-margin printing is performed on the paper 31 whose width is smaller than the whole width of the transportation belt 10, there is no fear that the non-printing surface of the paper is polluted with ink. In addition, differently from the case where a plurality of transportation belts are used, it is possible to reduce the deterioration in strength of the transportation belt 10 and the degree of inclination of the paper with its transportation.

Although a preferred embodiment of the invention has been described above, the invention is not limited to the embodiment. Various changes in design can be made on the invention without departing from the gist of the invention. For example, the longitudinal groove functioning as a second recess portion is dispensable in the transportation belt. Further, a plurality of parallel transportation belts each having crosswise grooves may be arranged in parallel. In addition, when the front end portion of each of kinds of papers to be used is controlled to be located in a crosswise groove, it is not necessary to provide a crosswise groove at a position corresponding to the rear end portion of each sheet of the kinds of papers. However, when crosswise grooves are provided to allow both the front and rear end portions of all the kinds of papers to be located in the crosswise grooves, the pollution of any paper with ink can be reduced on a large scale regardless of the kind of paper.

In the embodiment, the front end portion of paper is located in a crosswise groove by controlling the timing to start driving the feed rollers 5, which are parts of the print medium feed mechanism. However, the front end portion of paper may be located in a crosswise groove by controlling the timing to start driving the paper feed roller 23. Alternatively, the front end portion of paper may be located in a crosswise groove by controlling the timing to start driving the belt rotating mechanism for applying a rotating force to the transportation belt 10. Further, alternatively, the aforementioned configuration maybe implemented by simultaneously controlling the drive start timing of the feed rollers 5 or the paper feed roller 23 and the drive start timing of the belt rotating mechanism.

In addition, the ink absorbing members do not have to be disposed in any longitudinal and crosswise groove. In addition, each crosswise groove formed in the transportation belt does not have to be shared by papers different in length in the paper transporting direction. In addition, the number of grooves formed in the transportation belt may be increased or reduced suitably in accordance with kinds of papers to be used.

In addition, the ink absorbing members 15 and 32 may be formed out of materials other than urethane foam. Further, the transportation belt 10 does not have to have a two-layer structure. For example, the transportation belt 10 may have a layer structure of three or more layers or only one layer if crosswise and longitudinal grooves can be provided. In addition, the invention is applicable not only to a line type inkjet printer but also to a serial type inkjet printer.

As described above, according to the embodiment of the invention, when zero-margin printing is performed on a printing medium, non-printing surfaces of the printing media are prevented from being polluted with ink.

What is claimed is:

1. An inkjet printer comprising:

a plurality of rollers;

an endless transportation belt laid on the plurality of rollers and defining a first recess portion, which extends in a direction perpendicular to a printing medium transporting direction, in an outer circumferential surface thereof, wherein the first recess portion has a bottom defined by the transportation belt;

a belt rotating mechanism which applies a rotating force to the transportation belt;

a recording unit which is disposed to face the transportation belt and forms an image;

a printing medium supply mechanism which supplies a printing medium onto the transportation belt; and a control unit which controls at least one of the belt rotating mechanism and the printing medium supply mechanism so that when the printing medium is on the transportation belt, one of a front end portion and a rear end portion of the printing medium is located in the first recess portion.

2. The inkjet printer according to claim 1, wherein when the printing medium is on the transportation belt, the other of the front end portion and the rear end portion is located in the first recess portion.

3. The inkjet printer according to claim 1, wherein:

the first recess portion is a plurality of first recess portions; and the plurality of first recess portions includes plural types of recess portions different from each other in length in a width direction of the transportation belt.

4. The inkjet printer according to claim 1, further comprising an ink absorbing member on a bottom surface of the first recess portion.

5. The inkjet printer according to claim 1, wherein:

the transportation belt defines at least two second recess portions, which extend in the printing medium transporting direction and are connected with the first recess portion, in the outer circumferential surface thereof; and the printing medium supply mechanism supplies the printing medium, which is smaller in width than the transportation belt, onto the transportation belt so that when the printing medium is on the transportation belt, both side portions of the printing medium along the printing medium transporting direction are located in the second recess portions, respectively.

6. The inkjet printer according to claim 1, wherein:

the transportation belt defines at least one second recess portion, which extends in the printing medium transporting direction and is connected with the first recess portion, in the outer circumferential surface thereof; and the printing medium supply mechanism supplies the printing medium, which is smaller in width than the transportation belt, onto the transportation belt so that when the printing medium is on the transportation belt, one of both side portions of the printing medium along the printing medium transporting direction is located in the second recess portion and the other of the both side portions overreaches a side portion of the transportation belt.

7. The inkjet printer according to claim 5, further comprising an ink absorbing member on bottom surfaces of the first recess portion and the second recess portions.

8. The inkjet printer according to claim 6, further comprising an ink absorbing member on bottom surfaces of the first recess portion and the second recess portion.

9. The inkjet printer according to claim 1, wherein:

the first recess portion is a plurality of first recess portions; and the control unit controls the at least one of the belt rotating mechanism and the printing medium supply mechanism so that when the printing medium is on the transportation belt, the one of the front end portion and the rear end portion of the printing medium is located in a specific first recess portion.

10. The inkjet printer according to claim 9, wherein the specific first recess portion extends from one end of the transportation belt to another end thereof in the direction perpendicular to the printing medium transporting direction.

11. The inkjet printer according to claim 10, further comprising ink absorbing members disposed on both sides of the transportation belt, respectively.

12. The inkjet printer according to claim 10, further comprising:

a guide member disposed inside the transportation belt;

projection portions, which project from both side surfaces of the guide member, wherein the guide member and the projection portions define third recess portions; and ink absorbing members disposed in the third recess portions, respectively.

13. The inkjet printer according to claim 12, wherein:

the recording unit includes a plurality of inkjet heads, which eject ink to form the image; and the ink absorbing members have a length, which is equal to or larger than a total length of the inkjet heads, in the printing medium transporting direction.

14. The inkjet printer according to claim 1, wherein the recording unit includes a plurality of inkjet heads, which eject ink to form the image.

15. The inkjet printer according to claim 14, wherein the first recess portion has a length equal to or larger than that of one of the ink jet heads, in the printing medium transporting direction.

16. The inkjet printer according to claim 1, wherein when using one of plural kinds of printing media having different lengths in the printing medium transporting direction from each other, the control unit controls the at least one of the belt rotating mechanism and the printing medium supply mechanism so that when the printing medium used is on the transportation belt, the one of the front end portion and the rear end portion of the printing medium used is located in the first recess portion.

17. The inkjet printer according to claim 1, wherein the control unit controls the at least one of the belt rotating mechanism and the printing medium supply mechanism so that when the printing medium is on the transportation belt, the one of a front end portion and a rear end portion of the printing medium is located in the first recess portion without contacting a bottom surface of the first recess portion.

18. The inkjet printer according to claim 1, further comprising:

a guide member disposed inside the transportation belt;

projection portions, which project from both side surfaces of the guide member, wherein the guide member and the projection portions define recess portions; and ink absorbing members disposed in the recess portions, respectively.

19. The inkjet printer according to claim 1, wherein:

the transportation belt defines at least one second recess portion that extends in the printing medium transporting direction and around an entire outer circumferential surface of the transportation belt.

20. The inkjet printer according to claim 1, wherein:

the control unit controls at least one of the belt rotating mechanism and the printing medium supply mechanism such that, after the front end portion of the printing medium is detected, the printing medium supply mechanism is stopped until the transportation belt reaches a predetermined position.

* * * * *